United States Patent [19]

Fujiwhara et al.

[11] 4,416,980

[45] Nov. 22, 1983

[54] HIGH-CONTRAST LIGHT-SENSITIVE SILVER HALIDE PHOTOGRAPHIC MATERIAL

[75] Inventors: Mitsuto Fujiwhara; Syunji Matsuo; Toyoaki Masukawa; Yutaka Kaneko; Mikio Kawasaki, all of Tokyo, Japan

[73] Assignee: Konishiroku Photo Industry Co., Ltd., Tokyo, Japan

[21] Appl. No.: 184,095

[22] Filed: Sep. 4, 1980

Related U.S. Application Data

[63] Continuation of Ser. No. 91,558, Nov. 5, 1979, abandoned, which is a continuation of Ser. No. 869,657, Jan. 16, 1978, abandoned, which is a continuation-in-part of Ser. No. 710,385, Aug. 2, 1976, abandoned.

[30] Foreign Application Priority Data

Jan. 28, 1977 [JP] Japan ..... 52-7845

[51] Int. Cl.[3] ..... G03C 1/06

[52] U.S. Cl. ..... 430/567; 430/264; 430/438; 430/440; 430/564; 430/949; 430/496

[58] Field of Search ..... 430/496, 438, 440, 564, 430/567, 566, 598, 949, 264

[56] References Cited

U.S. PATENT DOCUMENTS

| | | | |
|---|---|---|---|
| 3,061,436 | 10/1962 | Himmelmann | 96/114.8 |
| 3,071,465 | 1/1963 | Dersch et al. | 96/109 |
| 3,185,567 | 5/1965 | Rogers | 96/54 |
| 3,420,664 | 1/1969 | Dersch et al. | 96/109 |
| 3,597,213 | 8/1971 | Dersch et al. | 96/109 |
| 3,740,226 | 6/1973 | Dappen et al. | 96/66 HD |
| 3,847,619 | 11/1974 | Bissonette | 96/110 |
| 3,891,442 | 6/1975 | Beavers | 96/108 |
| 3,909,268 | 9/1975 | Baldassarri et al. | 96/109 |
| 3,928,043 | 12/1975 | Ciurca | 96/95 |
| 3,957,491 | 5/1976 | Ohi | 96/109 |
| 4,175,966 | 11/1979 | Fujiwhara et al. | 430/438 |
| 4,233,400 | 11/1980 | Fujiwhara et al. | 430/949 |

OTHER PUBLICATIONS

Making & Coating Emulsions by Zelikman & Levi, pp. 277, 13, 1965.

*Primary Examiner*—Mary F. Downey

*Attorney, Agent, or Firm*—Frishauf, Holtz, Goodman & Woodward

[57] ABSTRACT

High-contrast light-sensitive silver halide photographic material which comprises a support, a silver halide emulsion layer containing silver halide and another hydrophilic colloidal layer coated on the support, at least one of said silver halide emulsion layer and another hydrophilic colloidal layer containing a substantially non-diffusible compound having oxidizing power on a hydroquinone developing agent, and the thickness, in an aqueous solution having the composition described as in the specification kept at 23° C., of said at least one layer being from 1.2–4.5 times that of said layer dried in an atmosphere at 23° C. at a relative humidity of 55%.

10 Claims, No Drawings

HIGH-CONTRAST LIGHT-SENSITIVE SILVER HALIDE PHOTOGRAPHIC MATERIAL

This is a continuation of application Ser. No. 91,558 filed Nov. 5, 1979, which, in turn, is a continuation of Ser. No. 869,657, filed Jan. 16, 1978, both now abandoned. Said Ser. No. 869,657 was a continuation-in-part application of application Ser. No. 710,385, filed Aug. 2, 1976, now abandoned in favor of Ser. No. 948,539, filed Oct. 4, 1978 now U.S. Pat. No. 4,175,966; Ser. No. 818,507, filed July 25, 1977 now abandoned; and Ser. No. 819,398, filed July 27, 1977 now abandoned.

This invention relates to a light-sensitive silver halide photographic material for forming a novel photographic image. Particularly, this invention relates to a light-sensitive silver halide photographic material for forming a silver image having high-contrast and/or a high-quality dot.

There has been known a method of forming extremely high-contrast photographic images using a known light-sensitive silver halide photographic material. For example, there has been known a method of forming a high-contrast image, for example, a dot image negative/positive or line image negative/positive by treating a light-sensitive silver halide photographic material comprising a silver chlorobromide or silver chloro-iodobromide which is of uniform fine grains having an average grain size of less than 0.5 μm and a narrow size distribution and a high-content of silver chloride (at least more than 50 mole percent) with an alkaline hydroquinone in an extremely small concentration of sulfite ion. Such a high-sensitive silver halide photographic material is known as a so-called lith type light-sensitive silver halide photographic material which is essential for the present printing process.

In a process of preparing a halftone image in photolithography, there is generally involved a process of treating a continuous density change of a manuscript, photographed on a lith type light-sensitive silver halide photographic material through a cross screen or a contact screen, with a developer called as an infectious or lith type developer. The lith type light-sensitive silver halide photographic material itself does not have adequate high-contrast. For example, even if it is developed with an available developer for photographic printing, the gamma (γ) is at least 5 or 6 and there is a lot of fringe occurrence which must be avoided in formation of dots. So, it is essential to use the lith type light-sensitive silver halide photographic material in combination with said lith type developer for dot negative/positive use.

Said infectious or lith type developer is described in detail at page 221 of Journal of Franklin Institute, Vol. 239 (1945) by J.A.C. Yule and means a developer of which the developing agent is only hydroquinone and in which the concentration of sulfite ion is small.

As expected from the composition, the lith type developer has a bad storability and liable to auto-oxidation. So, the control system to obtain a high-quality of dot negative/positive inevitably become complicated.

Because of the need for improving storability of the lith type developer, a lot of effort has been expanded but there has not been found a developer having storability comparable to Metolhydroquinone, which is for continuous gradation, or Phenidonehydroquinone, for example, Sakura Dol® type 311, 411 and 431 having high dot quality.

Also, as to the light-sensitive silver halide photographic material for facsimile receiving and photographic typesetting of computer, a silver iodobromide which is below 0.8μ of average grain size and has a narrow distribution of grain sizes is used. As is seen in adoption of strong light sources such as laser probe; high-efficiency of the facsimile receiving system and typesetting for computers is a great concern for those in the art. Also, high-sensitivity of light-sensitive silver halide photographic materials for facsimile and photographic typesetting has been strongly desired.

On the other side, as is generally known, making grains large to increase the silver halide high sensitivity causes unfavorable phenomena such as lowering of γ-value and roughness of image quality. In the light-sensitive silver halide photographic materials for photographic typesetting or facsimile, there is not known a method of overcoming this antinomy.

It is, therefore, the first object of this invention to provide a novel light-sensitive silver halide photographic material which can produce high-contrast silver images.

It is the second object of this invention to provide a novel light-sensitive silver halide black and white photographic material having high-contrast comprising a substantially non-diffusible compound having oxidation power on a hydroquinone developing agent in a hydrophilic colloidal layer (particularly a gelatin layer).

It is the third object of this invention to provide a novel light-sensitive silver halide photographic material suitable for obtaining line image negative/positive and dot image negative/positive available for plate making.

It is the fourth object of this invention to provide a novel light-sensitive silver halide photographic material comprising a hydrophilic colloidal layer, especially a gelatin layer with extremely high physical and physicochemical extremely high-stability.

It is the fifth object of this invention to provide a novel light-sensitive silver halide photographic material available for obtaining silver images with high-contrast and/or high quality dot.

The above objects and other objects, which will be described below, of this invention can be effected by incorporating, a light-sensitive silver halide photographic material comprising a hydrophilic colloidal layer containing a silver halide emulsion layer and optionally another hydrophilic layer coated on a support, a substantially non-diffusible compound having oxidation power on a hydroquinone developing agent contained in at least one of said hydrophilic colloidal layers and adjusting the thickness of said hydrophilic colloidal layer in an aqueous solution having the following composition [A] at 23° C. of from 1.2 to 4.5 times that of the dried layer measured at an atmosphere at 23° C. and at a relative humidity of 55%.

| Aqueous solution [A] | |
|---|---|
| Ethylenediamine tetraacetic acid disodium salt | 0.1 g |
| Sodium sulfite | 30 g |
| Potassium bromide | 2.5 g |
| Sodium carbonate monohydrate | 30 g |
| Water to make | 1 l |
| pH = 10.25 | |

That is, the present inventors found, after extensive research to accomplish the above objects, that these object could be attained by incorporating a substantially nondiffusible compound having oxidation power on a hydroquinone developing agent into a hydrophilic colloidal layer, especially a gelatin layer controlled for swelling in a developer. The light-sensitive silver halide photographic material according to this invention can be treated with a optional developer after imagewise exposure.

The hydrophilic collidal layer, especially a gelatin layer having the preferred swelling according to this invention means that the whole membrane thickness of said hydrophilic colloidal layer, especially gelatin layer, in said aqueous solution [A] at 23° C. is in a range of 1.2–4.5 times that of the dried layer measured in an atmosphere at 23° C. and at a relative humidity of 55%.

In this invention, "a compound having oxidation power on a hydroquinone developing agent", as will be described in detail herein, means a compound having a positive surface oxidation-reduction potential of the hydrophilic colloidal layer containing said compound (especially gelatin layer) in a buffer solution containing said developing agent against a surface oxidation reduction potential of the hydrophilic colloidal layer (especially gelatin layer) not containing said compound in said buffer solution containing said developing agent.

Further, it is preferred that when the oxidation power of said compound of this invention is sufficiently effective, the oxidation-reduction potential of said compound at a pH of 10.0 is 80 mV, especially 100 mV higher than that of hydroquinone.

Also in this invention, a substantially non-diffusible compound means a compound that can not be diffused out in a processing solution from the light-sensitive photographic material during development, and, in concrete terms, a compound which does not diffuse from the hydrophilic colloidal layer (especially gelatin layer) in an aqueous solution in a concentration of over a few percent, preferably over 2%, in cases where said hydrophilic colloidal layer (especially gelatin layer) containing said compound is immersed in an aqueous solution having the same ionic strength and the same pH as the developer described below at a temperature such as is applicable for the developer, for example, at a temperature of 20° to 40° C. for 10 minutes.

But said compound may be more diffusible within the scope of the effect of this invention.

Typical examples of substantially non-diffusible compounds having oxidation power on the said hydroquinone type developing agents according to this invention will be exemplified as follows, but they are not to be construed in a limiting manner.

1. N-chloroarylsulfonamide compounds represented by the general formula;

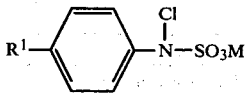

wherein $R^1$ represents an alkyl group including alkyl and substituted alkyl having 6 to 12 carbon atoms and M represents an alkali metal atoms such as sodium, potassium and so forth.

For example

N-chloro-p-dodecylbenzenesulfonamide sodium,

N-chloro-p-nonylbenzenesulfonamide sodium,

2. Quaternary salt of Nitrogen (a) Tetrazolium compounds having the following formulae [I], [II] and [III]:

Formula [I]

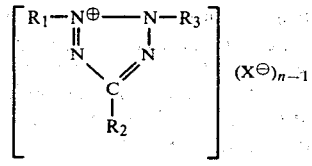

Formula [II]

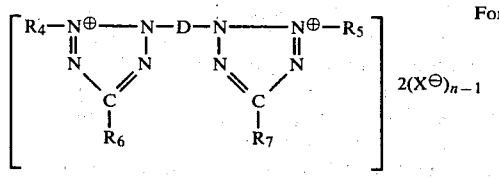

Formula [III]

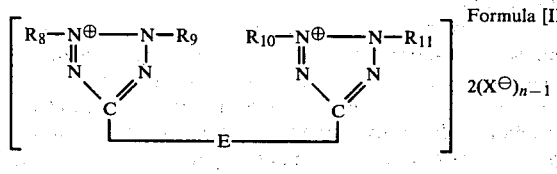

wherein $R_1$, $R_3$, $R_4$, $R_5$, $R_8$, $R_9$, $R_{10}$ and $R_{11}$ individually represent an alkyl group including alkyl and substituted alkyl, an allyl group including allyl and substituted allyl, a phenyl group including phenyl and substituted phenyl, a naphthyl group including naphthyl and substituted naphthyl, a heterocyclic group including heterocyclic and substituted heterocyclic or may be a group forming a metal chelate or complex; $R_2$, $R_6$ and $R_7$ individually represent an allyl group including allyl and substituted allyl, a phenyl group including phenyl and substituted phenyl, a heterocyclic group including heterocyclic and substituted heterocyclic, an alkyl group including alkyl and substituted alkyl, an amino group including amino and substituted amino, hydroxyl, carboxyl or salt thereof, mercapto, nitro or hydrogen; D represents an arylene group (preferably a divalent phenylene group including phenylene or substituted phenylene or a divalent naphthylene group including naphthylene and substituted naphthylene); E represents an alkylene group including alkylene and substituted alkylene, an allylene group including allylene or substituted allylene or an aralkylene group including aralkylene and substituted aralkylene; $X^{\ominus}$ represents an anionic surfactant having at least 9 carbon atoms; n represents the integer 1 or 2 providing that in case where the compound forms a molecular inner salt, n is 1.

Preferably said anionic surfactant having at least 9 carbon atoms being represented by the general formulae [IV], [V], [VI], [VII] and [VIII].

Formula [IV]

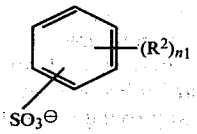

wherein $R^2$ represents an alkyl group including alkyl and substituted alkyl. $n_1$ is an integer of 1 to 3.

For example 4-iso-propylbenzenesulfonate 2,3,5-triethylbenzenesulfonate 4-dodecylbenzenesulfonate
4-(2-fluoro)-hexylbenzenesulfonate

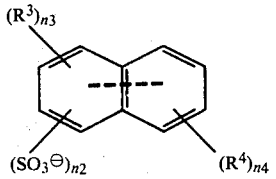

Formula [V]

wherein $R^3$ and $R^4$ individually represent hydrogen, an alkyl group including alkyl and substituted alkyl, $n_2$, $n_3$ and $n_4$ are an integer of 1 to 3.

For example
1,5-di-iso-propylnaphthalene-4-sulfonate
2,6-di-tert-amylnaphthalene-4-sulfonate
1,5-di-iso-propylnaphthalene-4,3-di-sulfonate
2,4-di-methyl-6-n-propylnaphthalene-8-sulfonate
1,5-di-(2-chloropentyl)-naphthalene-4-sulfonate $$R^5-\underset{\underset{R^6}{|}}{CH}\leftarrow R^7-O\rightarrow_{n_5}-A$$

Formula [VI]

wherein $R^5$ and $R^6$ individually represent hydrogen, an alkyl group including alkyl and substituted alkyl, $R^7$ represents ethylene group including ethylene and substituted ethylene and propylene group including propylene and substituted propylene, $n_5$ is an integer (preferably 10 to 100), A represents $-SO_3^{\ominus}$ and $-COO^{\ominus}$ For example $$C_2H_5-\underset{\underset{C_3H_7(n)}{|}}{CH}-(CH_2CH_2O)_{10}SO_3^{\ominus}$$

$$CH_3-\underset{\underset{CH_3}{|}}{CH}-(CH_2CH_2O)_{20}SO_3^{\ominus}$$

$$(n)C_{12}H_{25}-\underset{\underset{CH_3}{|}}{CH}-(CH_2CH_2O)_{30}SO_3^{\ominus}$$

$$CH_3\underset{\underset{OH}{|}}{CH}CH_2-\underset{\underset{C_2H_5}{|}}{CH}-(CH_2CH_2CH_2O)_{45}SO_3^{\ominus}$$

$$CF_3\underset{\underset{COOH}{|}}{CH}CH_2-\underset{\underset{CH_3}{|}}{CH}-(CH_2CH_2O)_{60}COO^{\ominus}$$

$$R^8-\underset{\underset{R^9-CH_2}{|}}{CH}-SO_3^{\ominus}$$

Formula [VII]

wherein $R^8$ represents hydrogen, an alkyl group including alkyl and substituted alkyl, and an alkyloxycarbonyl group including alkloxycarbonyl and substituted alkyloxycarbonyl group; $R^9$ represents an alkyl group including alkyl and substituted alkyl and an alkyloxycarbonyl group including alkyloxycarbonyl and substituted alkyloxycarbonyl.

For example $$(n)C_{12}H_{25}SO_3^{\ominus}$$

-continued $$\begin{array}{l} \qquad\qquad\qquad\qquad\qquad\qquad C_2H_5 \\ \qquad\qquad\qquad\qquad\qquad\qquad | \\ \qquad\qquad CH_2-COOCH_2-CH-(CH_2)_3-CH_3 \\ \qquad\qquad | \\ {}^{\ominus}O_3S-CH-COOCH_2-CH-(CH_2)_3-CH_3 \\ \qquad\qquad\qquad\qquad\qquad\qquad | \\ \qquad\qquad\qquad\qquad\qquad\qquad C_2H_5 \end{array}$$

$$\begin{array}{l} \qquad\qquad\qquad\qquad\qquad\qquad CF_3 \\ \qquad\qquad\qquad\qquad\qquad\qquad | \\ \qquad\qquad CH_2-COOCH_2-CH-(CH_2)_3CH_3 \\ \qquad\qquad | \\ {}^{\ominus}O_3S-CH-COOCH_2-CH(CH_2)_3CH_3 \\ \qquad\qquad\qquad\qquad\qquad\qquad | \\ \qquad\qquad\qquad\qquad\qquad\qquad CH_3 \end{array}$$

$$\begin{array}{l} \qquad\qquad CH_2-COO(CH_2)_7CH_3 \\ \qquad\qquad | \\ {}^{\ominus}O_3S-CH-COO(CH_2)_7CH_3 \end{array}$$

$$R^{10}-COO^{\ominus}$$

Formula [VIII]

wherein $R^{10}$ represents a saturated or an unsaturated alkyl group including alkyl and substituted alkyl.

For example
$n\text{-}C_{11}H_{23}COO^{\ominus}$
$n\text{-}C_{17}H_{35}COO^{\ominus}$
$CH_3(CH_2)_7CH{=}CH(CH_2)_7COO^{\ominus}$ The examples of the tetrazolium cation part are;
2-(Benzothiazol-2-yl)-3-phenyl-5-dodecyl-2H-tetrazolium,
2,3-Diphenyl-5-(4-t-octyloxyphenyl)-2H-tetrazolium,
2,3,5-Triphenyl-2H-tetrazolium,
2,3,5-Tri(p-carboxyethylphenyl)-2H-tetrazolium,
2-(Benzothiazol-2-yl)-3-phenyl-5-(o-chlorophenyl)-2H-tetrazolium,
2,3-Diphenyl-2H-tetrazolium,
2,3-Diphenyl-5-methyl-2H-tetrazolium,
3-(p-Hydroxyphenyl)-5-methyl-2-phenyl-2H-tetrazolium,
2,3-Diphenyl-5-ethyl-2H-tetrazolium,
2,3-Diphenyl-5-n-hexyl-2H-tetrazolium,
5-Cyano-2,3-diphenyl-2H-tetrazolium,
2-(Benzothiazol-2-yl)-5-phenyl-3-(4-tolyl)-2H-tetrazolium,
2-(Benzothiazol-2-yl)-5-(4-chlorophenyl)-3-(4-nitrophenyl)-2H-tetrazolium,
5-Ethoxycarbonyl-2,3-di(3-nitrophenyl)-2H-tetrazolium,
5-Acetyl-2,3-di(p-ethoxyphenyl)-2H-tetrazolium,
2,5-Diphenyl-3-(p-tolyl)-2H-tetrazolium,
2,5-Diphenyl-3-(p-iodophenyl)-2H-tetrazolium,
2,3-Diphenyl-5-(p-diphenyl)-2H-tetrazolium,
5-(p-Bromophenyl)-2-phenyl-3-(2,4,6-trichlorophenyl)-2H-tetrazolium,
3-(p-Hydroxyphenyl)-5-(p-nitrophenyl)-2-phenyl-2H-tetrazolium,
5-(3,4-Dimethoxyphenyl)-3-(2-ethoxyphenyl)-2-(4-methoxyphenyl)-2H-tetrazolium,
5-(4-Cyanophenyl)-2,3-diphenyl-2H-tetrazolium,
3-(p-Acetamidophenyl)-2,5-diphenyl-2H-tetrazolium,
5-Acetyl-2,3-diphenyl-2H-tetrazolium,
5-(Fur-2-yl)-2,3-diphenyl-2H-tetrazolium,
5-(Thien-2-yl)-2,3-diphenyl-2H-tetrazolium,
2,3-Diphenyl-5-(pyrid-4-yl)-2H-tetrazolium,
2,3-Diphenyl-5-(quinol-2-yl)-2H-tetrazolium,
2,3-Diphenyl-5-(benzoxazol-2-yl)-2H-tetrazolium,
2,3-Diphenyl-5-nitro-2H-tetrazolium,
2,2',3,3'-Tetraphenyl-5-5'-1,4-butylene-di-(2H-tetrazolium),
2,2',3,3'-Tetraphenyl-5,5'-p-phenylene-di-(2H-tetrazolium), 2-(4,5-Dimethylthiazol-2-yl)-3,5-diphenyl-2H-tetrazolium,
3,5-Diphenyl-2-(triazin-2-yl)-2H-tetrazolium,
2-(Benzothiazol-2-yl)-3-(4-methoxyphenyl)-5-phenyl-2H-tetrazolium, etc.

or other cation parts of tetrazolium compounds such as are disclosed in Chemical Review, 55, 355–483 (1955). Typical tetrazolium compounds are shown below.

2-(Benzothiazol-2-yl)-3-phenyl-5-dodecyl-2H-tetrazolium stearate,
2,3-Diphenyl-3-(4-t-octyloxyphenyl)-2H-tetrazolium laurate,
2,3,5-Triphenyl-2H-tetrazolium di-2-ethylhexylsulfosuccinate,
2,3,5-Tri(p-carboxyethylphenyl)-2H-tetrazolium stearate,
2-(Benzothiazol-2-yl)-3-phenyl-5-(o-chlorophenyl)-2H-tetrazolium p-dodecylbenzenesulfonate,
2,3-Diphenyl-2H-tetrazolium di-2-ethylhexylsulfosuccinate,
2,3-Diphenyl-5-methyl-2H-tetrazolium p-octylbenzenesulfonate.
3-(p-Hydroxyphenyl)-5-methyl-2-phenyl-2H-tetrazolium stearate,
2,3-Diphenyl-5-ethyl-2H-tetrazolium di-3-methylnonylsulfonate,
2,3-Diphenyl-5-n-hexyl-2H-tetrazolium p-octadecylbenzenesulfonate,
5-Cyano-2,3-diphenyl-2H-tetrazolium di-2-ethylhexylsulfosuccinate,
2-(Benzothiazol-2-yl)-5-phenyl-3-(4-tolyl)-2H-tetrazolium p-dodecylbenzenesulfonate,
2-(Benzothiazol-2-yl)-5-(4-chlorophenyl)-3-(4-nitrophenyl)-2H-tetrazolium di-isopropylnaphthalenesulfonate,
5-Ethoxycarbonyl-2,3-di(3-nitrophenyl)-2H-tetrazolium stearate,
5-Acetyl-2,3-di(p-ethoxyphenyl)-2H-tetrazolium laurate,
2,5-Diphenyl-3-(p-tolyl)-2H-tetrazolium stearate,
2,5-Diphenyl-3-(p-iodophenyl)-2H-tetrazolium laurate,
2,3-Diphenyl-5-(p-diphenyl)-2H-tetrazolium di-isopropylnaphthalenesulfonate,
5-(p-Bromophenyl)-2-phenyl-3-(2,4,6-trichlorophenyl)-2H-tetrazolium di-isopropylnaphthalene-di-sulfonate,
3-(p-Hydroxyphenyl)-5-(p-nitrophenyl)-2-phenyl-2H-tetrazolium p-dodecylbenzenesulfonate,
5-(3,4-Dimethoxyphenyl)-3-(2-ethoxyphenyl)-2-(4-methoxyphenyl)-2H-tetrazolium di-2-ethylhexylsulfosuccinate,
5-(4-Cyanophenyl)-2,3-diphenyl-2H-tetrazolium laurate,
3-(p-Acetamidophenyl)-2,5-diphenyl-2H-tetrazolium stearate,
5-Acetyl-2,3-diphenyl-2H-tetrazolium p-octadecylbenzenesulfonate,
5-(Fur-2-yl)-2,3-diphenyl-2H-tetrazolium di-2-ethylhexylsulfonate,
5-(Thien-2-yl)-2,3-diphenyl-2H-tetrazolium stearate,
2,3-Diphenyl-5-(pyrid-4-yl)-2H-tetrazolium laurate,
2,3-Diphenyl-5-(quinol-2-yl)-2H-tetrazolium stearate,
2,3-Diphenyl-5-(benzoxazol-2-yl)-2H-tetrazolium laurate,
2,3-Diphenyl-5-nitro-2H-tetrazolium di-isopropylnaphthalenesulfonate,
2,2',3,3'-Tetraphenyl-5,5'-1,4-butylene-di-(2H-tetrazolium) di-3-propylnonylsulfonate,
2,2',3,3'-Tetraphenyl-5,5'-p-phenylene-di-(2H-tetrazolium) p-dodecylbenzenesulfonate,
2-(4,5-Dimethylthiazol-2-yl)-3,5-diphenyl-2H-tetrazolium stearate,
3,5-Diphenyl-2-(triazin-2-yl)-2H-tetrazolium laurate,
2-(Benzothiazol-2-yl)-3-(4-methoxyphenyl)-5-phenyl-2H-tetrazolium p-tolylsulfonate,
2-p-Iodophenyl-3-p-nitrophenyl-5-phenyl-2H-tetrazolium di-isopropylnaphthalene-di-sulfonate,
2,3,5-Triphenyl-2H-tetrazolium di-isopropylnaphthalene-di-sulfonate.

(b) Triazolium compounds having the formula; $[T]^{\oplus}(X^{-})_n$. $[T]^{\oplus}$ represents triazolium compound, $X^-$ represents as same as described in previous term (a), n is 1.

Examples of T are;
1-Methyl-2-phenyl-2H-1,2,3-triazolium,
1-n-propyl-2-phenyl-2H-1,2,3-triazolium,
2-(4-Methoxyphenyl)-3-phenyl-2H-naphtho[1,2-d]-1,2,3-triazolium,
1,5-(9,10-anthraquinolyl)-bis-{2-[3-phenyl]-2H-naphtho-[1,2-d]-1,2,3-triazolium}
2,3-di(4-Methoxyphenyl)-5-nitro-2H-naphtho-[1,2-d]-1,2,3-triazolium.

(c) bipyridinium compounds having the formula; $[B]^{2+}(X^{-})_2$ $[B]^{2+}$ represents a bipyridinium cation, $X^-$ represents as same as described in previous term (a).

Examples of $[B]^{2+}$ are;
1,1'-Dimethyl-4,4'-bipyridinium
1,1'-Diethyl-4,4'-bipyridinium
1,1'-Dibenzyl-4,4'-bipyridinium By making an appropriate selection of anion and cation part, the substantially non-diffusible compounds having oxidation power on hydroquinone developing agents according to this invention can be prepared.

The non-diffusible oxidants thus obtained are, for example, 2,3,5-triphenyl-2H-tetrazolium dioctyl succinate sulfonate salt, etc. As will be illustrated in detail in the Examples, these compound can be incorporated into a gelatin matrix either by dissolving the respective soluble salt in gelatin and then mixing them or by synthesizing the pure crystalline oxidant, dissolving it in a suitable solvent such as dimethylsulfoxide, and then dispersing it into gelatin matrix. When the dispersion is difficult to be rendered uniform, it is useful to use suitable homozenizers, such as ultrasonic or colloid mill homozenizers.

3. Metal complex compounds represented by the general formula; $[M'-Z]^{n'\oplus}(X^{\ominus})_{n'}$ M' represents a metal, n' is an integer of 2 to 4, Z represents ligands which form metal complex compounds ($X^{\ominus}$) represents the same as described in previous term 2.

Examples of $[M'-Z]^{\ominus}$ above are; hexaammine cobalt (III), triethylenediamine cobalt (III), bis(diethanolamine) cobalt (III), hexaammine chromium (III), bis(dipropanolamine) chromium (III), bis(ethylenediamine) trimethylenediamine cobalt (III); ethylenediamine tetraacetic acid iron (III); etc. These compounds can be used like quaternary nitrogen salts by making salts of these compounds with anion parts as described in above quaternary nitrogen salts.

4. Other non-diffusible inorganic oxidants: tetraphenylphosphonium bichromate, tetraphenylphosphonium permanganate, tetraphenylarsonium perchromate, etc.

The light-sensitive silver halide photographic material can be incorporated with at least one non-diffusible oxidant of this invention but may be incorporated with two or more non-diffusible oxidants in combination.

Among non-diffusible oxidants used in this invention, the most preferred embodiments are the compounds composed of 2,3,5-triphenyl-2H-tetrazolium and diisopropylnaphthalene sulfonic acid, and 2,3,5-triphenyl-2H-tetrazolium and diethylhexyl succinate sulfonic acid.

The layer that can be incorporated with the non-diffusible oxidant according to this invention is a hydrophilic colloidal layer, preferably a silver halide emulsion layer and/or a gelatin layer adjacent to said silver halide emulsion layer. That is, in a preferable embodiment of this invention, the non-diffusible oxidant can be incorporated into a silver halide emulsion layer or the layer containing a silver halide emulsion. In another preferable embodiment, said non-diffusible oxidant can be incorporated into a layer directly adjacent to the silver halide emulsion layer or a layer containing the silver halide emulsion, or into a hydrophilic colloidal layer, especially gelatin layer, adjacent through another hydrophilic colloidal layer (intermediate layer). According to another embodiment, said non-diffusible oxidant which is dispersed oil-protectedly using the solvent disclosed in, for example, U.S. Pat. No. 2,322,027 and 2,533,514 can be incorporated into a hydrophilic colloid layer.

The non-diffusible oxidants are generally stable under any coating conditions used in the art and are substantially non-diffusible under development treating conditions.

According to one of preferred embodiments of this invention, the hydrophilic colloidal layer which is incorporated with an ion pair of tetrazolium cation and diethyl hexyl succinate sulfonic acid (hereinafter, referred to as DES) anion shows outstanding high-contrast in comparison with that obtained in the same way by coated with diffusible tetrazolium chloride. But according to the analysis described hereinafter, an elution of the former, that is, the ion pair of tetrazolium cation and DES anion from the light-sensitive silver halide photographic material into the processing solution is less than several percent, thus showing that the compound of this invention is substantially non-diffusible.

According to another embodiment of non-diffusible oxidants of this invention, a hydrophilic colloidal layer which is incorporated with an ion pair of hexaammine cobalt (III) cation and DES anion and adjacent to the silver halide emulsion layer gives outstanding high-contrast images in comparison with that obtained in the same way coated with hexaamine cobalt (III) chloride. According to the same analysis, the pair of hexaammine cobalt (III)-DES is substantially non-diffusible during the development process.

An addition amount of the compounds according to this invention is not limited but preferably is used in a range of 0.0001 to 10 moles, preferably over 0.001 mole per one mole of silver of the light-sensitive silver halide photographic material. That is, in the case of incorporating said non-diffusible oxidant into a silver halide emulsion layer, it is preferred to add it so as to contain said addition amount and in the case of incorporating into other hydrophilic colloidal layers, it is preferred to add it so as to contain said addition amount per one mole of silver.

Some prior art for the improvement of various photographic characteristics by incorporating an oxidant or compound having oxidizing power into a light-sensitive silver halide photographic material has been known and such art is disclosed in such Patents as U.S. Pat. Nos. 3,503,741, 3,909,268, Provisional Patent Publication (hereinafter, referred to as PPP) No. Sho 49-90120/1974, Research Disclosure No. 10908, etc. But the present invention is different in terms of concrete settlement and action and effect from this prior art. Therefore, the present invention is based on a different technical idea from them. For example, the invention disclosed in U.S. Pat. No. 3,503,741 concerns a silver-dye-bleach process and a process of improving a decrease in effective sensitivity which is a defect in the silver dye-bleach process. According to the disclosure of the specification of U.S. Pat. No. 3,503,741, a colorless tetrazolium salt dye precursor contained in a light-sensitive silver halide photographic material is developed to form a dye, and thereafter followed by a silver-dye-bleach process.

The fact that the tetrazolium salt used in U.S. Pat. No. 3,503,741 is a kind of oxidant is similar to this invention. But, the invention disclosed in said specification relates to a process of obtaining a color image. Therefore, the tetrazolium salt is used as a color image forming substance and finally a reversal dye color image is obtained. These points are essentially different from this invention in object, constitution and effect. Also in U.S. Pat. No. 3,909,268, there is disclosed a light-sensitive silver halide photographic material containing tetrazolium-o-oxybetaine compounds, but these are all diffusible compounds. This point is different from this invention using non-diffusible compounds. Therefore, according to the process disclosed in U.S. Pat. No. 3,909,268, the same object as that in this invention cannot be achieved and deterioration of photographic characteristics such as decrease in a maximum density occurs. Furthermore it is impossible to obtain a good dot quality with development process using a developer not belonging to a lith type developer. There is disclosed in PPP No. Sho 49-5333 the fact that sensitization can be achieved by treating a lith type light-sensitive silver halide photographic material with a solution containing an oxidant before development.

Also in the specification of U.S. Pat. No. 3,977,379, there is disclosed that improvement of sensitization and dot quality can be effected by incorporating iodide or an iodate into a layer adjacent to the silver halide emulsion layer and treating it with a lith type developer. But all oxidants incorporated in these light-sensitive silver halide photographic materials are diffusible and different from non-diffusible oxidants used in this invention. Therefore, the same object of this invention can not be accomplished. Further in the development other than this invention, the effect of high-contrast can not be achieved when treated with so-called MQ or PQ development. Also in the above Research Disclosure No. 10,908, there is disclosed a light-sensitive silver halide photographic material incorporated with a metal compound such as chromium or cobalt and ammonia trimethylenediamine or diethanolamine into a light-sensitive silver halide photographic material containing silver chloroiodo-bromide emulsion. It is said that said light-sensitive silver halide photographic material, which also incorporates azaindene, shows better characterics and gives high-contrast even without using a harmful cadmium salt. Also, there is disclosed in said Research Disclosure that in said metal complex compound ion pairs such as chlorides, bromides and perchlorates can be used. But these compounds are subject to diffusion compared with the non-diffusible oxidants used in this invention and incorporation of said compound into a light-sensitive silver halide photographic material does not show remarkable high-contrast such as this invention and therefore dot quality improvement can not be expected. On the contrary, bad affects such as desensitization during storage occur and there has not been developed an effective measure for protecting these defects and there is a problem for practical use.

But in the process of incorporating a non-diffusible oxidant according to this invention into a hydrophilic colloidal layer, improvements of the characteristics of a developer usually called lith type developer can not be only expected, but also extremely better dot quality can be obtained in the case of treatment of this light-sensitive silver halide photographic material with a developer which is not expected to give conventional lith developability of a colouring developer or paper developer, that is, extremely high-contrast.

Further in British Patent No. (referred to B.P.) 1,214,982 there is disclosed the fact that cobalt salts can be used in an extremely low concentration as stabilizer and anti-foggants. But in cases where the cobalt salt is added in a high concentration into a silver halide emulsion, and especially when the water-soluble cobalt salts are used, a remarkable desensitization occurs and it is also impossible to accomplish the object of this invention. Recently, in U.S. Pat. No. 3,765,891, there is disclosed a process of incorporating a cobalt (III) cation complex in a high concentration into a silver halide emulsion. Another process is also disclosed in Research Disclosure Nos. 10927 and 10926 and U.S. Pat. No. 3,847,619. But in each process, remarkable desensitization results and the improvement of high-contrast and especially the improvement of the dot quality can not be expected and is not disclosed. And most of those examples concern light-sensitive silver halide color photographic materials. On the contrary, in cases where the light-sensitive black-white silver halide photographic material containing anion pair of a substantially non-diffusible cobalt (III) cation complex compound according to this invention is treated with a developer containing developing agents such as hydroquinone, para-aminophenol, Metol®, phenylenediamine, Phenidone®, ascorbic acid, etc., in single or in combination of several agents, without any remarkable desensitization, an unexpected and extremely high-contrast silver image can be obtained. A still more astonishing thing is that excellent dot silver images can be obtained without using a lith type developer. In this way, in all this prior art which is applicable to a light-sensitive silver halide photographic material containing a compound having oxidizing power, their object or concrete constitution is different from that of this invention and a process of obtaining remarkably high-contrast effects and/or forming excellent dot images without using the lith type developer has not been found before this invention.

The hydrophilic colloidal layer containing non-diffusible oxidants according to this invention is necessary to be adjusted in order that the membrane thickness of said hydrophilic colloidal layer in said aqueous solution [A], especially the whole membrane thickness comprising the one or more other hydrophilic colloidal layers is 1.2–4.5 times that of the dried membrane. Outside of this range, deterioration of the characteristics, such as high-contrast insufficiency, can be seen.

In the technique for adjusting said characteristics of this invention, there is at first an art to use so-called hardening.

Examples of hardening agents used for hardening treatment of the hydrophilic colloidal layer are formaldehyde, glutaraldehyde; aldehyde compounds such as dialdehyde of polydextrose disclosed in PPP No. Sho 45-9578/1970; ketone compounds such as diacetyl and cyclopentanedione; bis(2-chloroethylurea), 2-hydroxy-4,6-dichloro-1,3,5-triazine; active halogen containing compounds such as are disclosed in U.S. Pat. No. 3,288,775 and 2,732,303, BP 974,723 and 1,167,207, divinylsulfone, 5-acetyl-1,3-diacryloylhexahydro-1,3,5-triazine and 1,3,5-triacryloyl-1,3,5-triazine; reactive olefine compounds such as are disclosed in U.S. Pat. Nos. 3,635,718 and 3,232,763 and BP No. 994,869; N-hydroxymethylphthalimide; N-Methylol compounds such as are disclosed in U.S. Pat. Nos. 2,732,316 and 2,586,168; isocyanate such as are disclosed in 3,103,437; aziridine compounds such as are disclosed in 3,017,280 and 2,983,611; acid derivatives such as are disclosed in 2,725,294 and 2,725,295; carbodiimide compounds such as are disclosed in 3,100,704, epoxy compounds such as are disclosed in 3,091,537; isoxazole compounds such as are disclosed in 3,321,313 and 3,543,292; halogenocarboxyaldehydes such as mucochloric acid; dioxanes such as dihydroxydioxane and dichlorodioxane or chrome alum or zirconium sulfate as inorganic hardening agents.

Instead of above compounds there can be used compounds acting as precursors such as alkali metal bisulfide aldehyde additives, methylol derivatives of hydantoin and primary aliphatic nitroalcohols.

To regulate swelling of the hydrophilic colloidal layer according to this invention, the following procedures can be adopted; to coat a thin polymer layer on the light-sensitive silver halide photographic material such as is disclosed in U.S. Pat. No. 3,502,501 and Japanese Patent Publication (refer to JPP) No. Sho 45-33468/1970; to incorporate water-insoluble polymers such as are JPP Nos. Sho 45-18415 and 45-19951/1970 into the hydrophilic colloidal layer; to incorporate the following compound into the light-sensitive silver halide photographic material and the hydrophilic colloidal layer (e.g. gelatin layer) composed of the light-sensitive silver halide photographic material at a range such as is not detrimental to the effect of this invention; water-soluble polymers such as are disclosed in BP 523,661 West German Patent Publication (refer to GP) 2,255,711 and 2,046,682 and U.S. Pat. No. 3,341,332; phenylcarbamyl gelatin, acylated gelatin and phthalylated gelatin such as are disclosed in U.S. Pat. No. 2,614,928 and 2,525,753; graft-polymers of polymerizable monomer having an ethylene group such as styrene acrylate, acrylate, methacrylic acid and methacrylate with gelatin such as are disclosed in U.S. Pat. Nos. 2,548,520 and 2,831,767.

The reason for controlling swelling in the hydrophilic colloidal layer according to this invention is still a matter of conjecture. But this will involve a mechanism wherein a chemical species which is sufficiently active to initiate an infectious development or an infectious development-wise high-contrast development, is at first prepared and then accumulated if necessary.

The non-diffusible oxidants according to this invention prepare a more active chemical species for development by oxidizing part of the developing agent which is incorporated into a hydrophilic colloidal layer. The same development active chemical species can also be prepared in the process of forming a silver image by reducing silver halide with the developing agent. The first process will be excellent in this invention. But contribution of these two processes can be regulated by adjusting developing an amount and/or an amount ratio of a non-diffusible oxidant incorporated into a hydrophilic colloidal layer and a development retarder or a development accelerator contained in a hydrophilic colloidal layer and/or a developer. Here, the swelling of the hydrophilic colloidal layer in a developer effects a great influence on diffusion of a developing agent, development retarder or development accelerator. The above development active chemical species are necessary to be accumulated in a definite time at an extremely local developable site.

A swelling adjusting process of the hydrophilic colloidal layer consisting of a light-sensitive silver halide photographic material of this invention can easily meet these conditions.

The merits according to the adjustment of swelling of the hydrophilic colloidal layer comprising of a light-sensitive silver halide photographic material according to this invention is extremely great: improvement of reducing characteristics, prohibition of occurrence of stains in retouch, as well as further surprising improvement of dot quality and of reproducibility of a shadow or highlight part, providing large sub-exposure characteristics, prohibition of sensitivity variation when allowed to stand. Such improvements of the characteristics such as are insufficient in conventional techniques can be clearly possible.

The merits of the adjustment of swelling of the hydrophilic colloidal layer is that high quality dots can be formed by such a rapid treatment as in a tray or a tank, or an auto processor. Therefore, it is of course that reproduction of high-contrast images which do not belong to dot images is practicable.

The light-sensitive silver halide photographic material according to this invention is provided with at least one silver halide emulsion layer coated on a support. The light-sensitive silver halide photographic material of this invention may be also provided with said silver halide emulsion layer and other hydrophilic colloidal layer, coated on the support. Further, a preferred embodiment of the light-sensitive silver halide photographic material is provided with a protecting layer composed of hydrophilic colloid, preferably gelatin (of membrane thickness of 0.5 to 2.0 μm when dried) on the most outside layer of the hydrophilic colloidal layer containing the silver halide emulsion layer coated on the support. Such adjustment that the membrane thickness of the hydrophilic colloidal layer containing this protecting layer in the aqueous solution [A] kept at 23° C. is 1.2 to 4.5 times that of the dried membrane in an atmosphere at 23° C. and at a relative humidity of 55% is preferred in this invention.

The light-sensitive silver halide photographic materials which are used for this invention can be any of known silver halide such as silver bromide, silver chlorobromide, silver iodobromide, silver chloro-iodo-bromide and silver chloride and so forth, all of which are used in usual silver halide emulsions. These silver halides may be of rough or fine grains and can be prepared by any known method such as is disclosed in U.S. Pat. Nos. 2,592,250, 3,276,877, 3,317,322, 2,222,264, 3,320,069, 3,206,313 or J. Photo. Sci., 12 242–251 (1964). Further, the silver halides prepared by different methods may be used by mixing them.

The silver halide incorporated in the silver halide emulsion layer used in this invention is preferred to be a silver halide which has an average grain size range of 0.05 to 1.5 μm, preferably 0.1 to 0.8 μm and of which at least 75%, especially over 80% of the whole grain number is 0.6 to 1.4 times, especially 0.7 to 1.3 times said average grain size. In one of the most preferred embodiments of this invention, the silver halide of this invention is a silver chloro-iodo-bromide or silver chlorobromide which has an average grain size range of 0.25 to 0.5 μm and of which over 80% of the whole grain nubmer is 0.7 to 1.3 times said average grain size.

The silver halide emulsions according to this invention may be sensitized with one or more of chemical sensitizers such as active gelatin; sulfur sensitizers, e.g. sodium thiosulfate, allylthiocarbamide, thiourea and allylisocyanate, selenium sensitizers, e.g. N,N-dimethylselenourea and serenourea, reduction sensitizers, e.g. triethylenetetramine and stannic chloride and noble metal sensitizers, e.g. potassium chloroaurite, potassium autithiocyanate, potassium chloroaurate, 2-aurosulfobenzothiazol methyl chloride, ammonium chloropalladate, potassium chloroplatinate and sodium chloropalladite. In the case of using gold sensitizers, ammonium thiocyanate can be used as an aid. Further, the silver halide emulsions may be optically sensitized with one or more of sensitizing dyes so as to have sensitivity in a desired region of sensitive wave length. Various kinds of sensitizing dyes can be used, but the preferred sensitizing dyes are such as cyanines, merocyanines, three or four nucleus merocyanines, three or four nucleus cyanines, styriles, holopolarcyanines, hemicyanines, oxonols and hemioxonols. These optical sensitizers may contain, as heterocyclic ring nucleus at a part of them, nuclei such as basic radicals, e.g. thiazoline and thiazole, nuclei containing such as rhodanine, thiohydantoine, oxazolidinedione, barbituric acid, thiobarbituric acid and pyrazolone and these nuclei may be substituted with alkyl, hydroxyalkyl, halogen, phenyl, cyano or alkoxy radicals and condensed with aryl or heterocyclic ring. The silver halide emulsions may be stabilized with compounds which are disclosed in U.S. Pat. Nos. 2,444,607, 2,716,062, 3,512,982, GP 1,189,380, U.S. Pat Nos. 3,726,686, 3,717,465, JPP No. Sho 43-4133/1968, U.S. Pat No. 3,342,596, No. Sho 47-4417/1972, BP No. 1,363,921, JPP Nos. Sho 39-2825/1964, 49-13566/1974 and preferred compounds are such as 5,6-trimethylene-7-hydroxy-s-triazolo(1,5-a)pyrimidine, 5,6-tetramethylene-7-hydroxy-s-triazolo(1,5-a)pyrimidine, 5-methyl-7-hydroxy-s-triazolo(1,5-a)pyrimidine, 7-hydroxy-s-triazolo(1,5-a)pyrimidine, 5-methyl-6-bromo-7-hydroxy-s-triazolo(1,5-a)pyrimidine, galic acid esters (e.g. isoamyl gallate, dodecyl gallate, propyl gallate and sodium gallate), mercaptans (e.g. 1-phenyl-5-mercaptotetrazole, 2-mercaptobenzothiazole), benzotriazoles (e.g. 5-bromobenzotriazole, and 4-methylbenzotriazole) and benzoimidazoles (e.g. 6-nitrobenzoimidazole). In the silver halide emulsions according to this invention, latent image stabilizers of amino acid compounds containing sulfur such as are disclosed in BP No. 1,343,904 and U.S. Pat. No. 3,821,295 and gradation regulators such as cadmium salts and rhodium salts can be used but sufficient high-contrast light-sensitive silver halide photographic materials can be obtained in this invention without using gradation regulators. In order to enhance contrast in the silver halide emulsion, a method of using rhodium or cadmium salts are heretofore known and are disclosed in BP No. 775,197, U.S. Pat. No. 3,488,709 etc. In the case of use of rhodium salts, the optimum added amount is in an extremely small quantity, and extremely narrow in its range, so that the products are apt to vary widely and some problems remain unsolved for preparing stable light-sensitive silver halide photographic material. On the other hand, in the case of the use of cadmium salts, only an extremely small amount should be added because, in the case of film treatment, the cadmium salt should be finally washed off, so they contaminate the environment. Cadmium salt are known to hinder metabolism and to be harmful to ecological systems. Cadmium can be detected not only in the air but also in body of marine animals. In a view of toxicity of cadmium and traces of other metals and in consideration of public health and usual ecological balance, this invention has provided a novel method of obtaining sufficient high-contrast light-sensitive silver halide photographic materials without using harmful metals.

In the hydrophilic colloids according to this invention, there can be incorporated, if necessary, any photographic additives in a range such as not to impair the effect of this invention. These are gelatin plasticizers, hardening agents, surface active agents, image stabilizers, antistaining agents, pH adjusters, antioxidants, antistatic agents, viscosity increasing agents, granularity improving agents, dyes, mordants, brightening agents, development regulators, matting agents and the like.

Among the said additives, preferred additives are as follows: viscosity increasing agents or plasticizers such as are disclosed in U.S. Pat. No. 2,960,404, JPP No. Sho 43-4939/1968, GP No. 1,904,604, U.S. Pat. No. 3,656,956, PPP No. Sho. 48-63715/1973, JPP No. Sho 45-15462/1970, Belgian Patent (refer to Bel. P) No. 762,833, U.S. Pat. Nos. 3,767,410 and 3,692,753, for example, copolymer of styrene and sodium maleate and dextran sulfate; image stabilizers are 6,6'-butylidenebis(2-t-butyl-4-methylphenol) and 4,4'-methylenebis(2,6-di-t-butylphenol) and the like. As surface active agents which are used as permiability improving agents of coating aids, emulsifying agents and treatment liquid, antifoggants or controller of several physical characters in light-sensitive silver halide photographic materials, anionic, cationic, non-ionic or amphoteric compound can be used which are disclosed in BP Nos. 548,532, 1,216,389, U.S. Pat. Nos. 3,026,202, 3,514,293, JPP Nos. Sho 44-26580/1969, 43-17922, -17926, -13166/1968, 48-20785/1973, France Patent Nos. (refer to FP) 202,588, U.S. Pat. No. 3,726,683, FP No. 2,174,112; mordant are such compounds as are disclosed in U.S. Pat. Nos. 2,113,381, 2,548,564 and the like; antistain agents are compounds such as are disclosed in U.S. Pat. Nos. 2,360,210, 2,728,659, 2,732,300, 3,700,453, e.g. 2-methyl-5-hexadecylhydroquinone, 2-methyl-5- sec-octadecylhydroquinone and 2,5-di-t-octylhydroquinone; antistatic agents are such compounds as are disclosed in U.S. Pat. No. 3,573,093, PPP No. Sho 48-89979/1973, U.S. Pat. Nos. 2,882,157, 2,972,535, PPP No. Sho 48-20785/1973, BP 1,378,584, PPP No. Sho 48-90391/1973, JPP Nos. Sho 46-24159/1971, 49-64/1974, U.S. Pat. Nos. 3,549,369 and 3,663,230 and PPP No. Sho 47-33627/1972; matting agents are those such as are disclosed in BP No. 1,221,980, U.S. Pat. Nos. 2,992,101, 2,956,884, FP No. 1,395,544 and BP No. 1,307,373, especially silica gel having 0.5–20 μm in diameter and a polymer of polymethyl acrylate of 0.5–20 μm in diameter; as development accelerators, such compounds as benzylalcohol polyethyleneoxide and addition polymer of polyoxyethylene and glycidol may be used and added effectively in a treatment bath.

The light-sensitive silver halide photographic materials according to this invention may be coated on a suitable photographic support in the form of silver halide emulsion containing the said several photographic additives and other hydrophilic colloidal layer. The supports used for this invention are baryta paper, paper coated with polyethylene, polypropylene synthetic paper, glass plate, cellulose acetate, cellulose nitrate, polyester film such as polyethylene terephthalate, polyamide film, polypropylene film, polycarbonate film, polystyrene film and the like. These supports can be adequately chosen according to the use intended for the light-sensitive photographic materials. Among these supports, polyethyleneterephthate having excellent size stability is better as a support of this invention.

The images obtained by treating the light-sensitive silver halide photographic material, after being exposed imagewise, with an optional developer have high-contrast silver images, so this invention can be applicable to several fields requiring high-contrast black and white records. The light-sensitive silver halide photographic materials used in this invention are preferably applicable to, for example, lith type light-sensitive silver halide photographic materials, facsimile receiving light-sensitive silver halide photographic materials, computer typesetting for light-sensitive silver halide photographic materials, copying light-sensitive silver halide photographic materials, micro light-sensitive silver halide photographic materials, reproduction light-sensitive silver halide photographic materials, industrial X-ray sensitive silver halide photographic materials, etc., and have excellent characteristics which have not been achieved in the light-sensitive silver halide photographic materials of forming dot images. That is, even if sulfite ion concentration in the developer used for treating the light-sensitive silver halide photographic material according to this invention is increased, better dot images can be obtained, so that there can be contained in said developer sulfite ion contents sufficient to make it difficult or to make it almost impossible for the developer to be subject to auto-oxidation.

For example, it is preferable to treat the light-sensitive silver halide photographic material of this invention with a developer which contains over 15 g of a sulfite in 1 l and of which pH value is at a range of 9.5 to 11.0. In said sulfite ion there can be contained sodium sulfite, potassium sulfite, ammonium sulfite, etc.

A developing agent for the developer used for treatment of a light-sensitive silver halide photographic material of this invention is not limited in structure or physical and chemical properties and can be broadly selected from developing agents which are known as developing agents for silver halide. As typical examples, developing agents used for treatment of the high-sensitive silver halide photographic material of this invention are organic or inorganic developing agents and development auxiliary agents disclosed in "The Theory of the Photographic Process" Third Edition, pages 278–381 (1966) by E. K. Mees and T. H. James and they can be used in single or in combination of two or more. They are preferably iron (II) oxalate, hydroxylamine, N-hydroxymorpholine, hydroquinones such as hydroquinone, hydroquinone monophosphate, chlorohydroquinone and t-butylhydroquinone, catechol, resorcin, pyrogallol, pyrazolidones such as Amidol ® and Phenidone ®, para-aminophenols such as para-aminophenole glycin and Metol ®, para-phenylenediamines such as p-phenylenediamine, 4-amino-N-ethyl-N-ethoxyaniline and ascorbic acid. They are more preferable Metol ® alone, combination of Phenidone ® and Metol ®, Metol ® and hydroquinone, Phenidone ® Metol ® and t-butylhydroquinone, Phenidone ® and ascorbic acid, and Phenidone ® and p-aminophenol. Further the use of several other combination of them causes the same improved results.

The developing agent incorporated into the developer used for treatment of the light-sensitive silver halide photographic material is used in an equal amount and at in the range of $10^{-5}$ to 1 mole per one liter of the developer.

In the developer used for treatment of the light-sensitive silver halide photographic materal of this invention, there can be optionally added, with the above developing agent, a preservative such as a sulfite and hydroxylamine, a compound for regulation of pH and with buffer ability such as a caustic alkali, an alkali carbonate, an alkali borate and an amine, which are used in black and white developer, an inorganic developer retarder such as potassium bromide and an organic development retarder such as benzimidazole, benztriazole and nitroindazole disclosed in BP No. 1,376,600.

Especially the light-sensitive silver halide photographic material of this invention is not apt to vary with the amount of potassium bromide in the developer in relation to the photographic characteristics such as sensitivity and dot quality, so that in the case of continuous treatment in an auto processor it has a better reproducibility than conventional light-sensitive silver halide photographic materials.

Further in the developer used for the treatment of the light-sensitive silver halide photographic material according to this invention, such additives as a high-contrast agent and toe part cutting agent which are used in conventional high-contrast developers can be added and the addition of does not cause any bad effect on the photographic characteristics.

The non-diffusible oxidants of this invention are preferred to the incorporated into the hydrophilic colloidal layer, as described above but this invention is not limitative to this. For example, the non-diffusible oxidants of this invention can be incorporated into the light-sensitive silver halide photographic material by dissolving the oxidant into a suitable organic solvent and directly coating the solution on the outermost side of the light-sensitive silver halide photographic material by means of an overcoat method or on the outermost of the light-sensitive silver halide photographic material on preparation.

This invention will be hereinafter illustrated by examples but these are not meant to limit the scope of this invention and several modifications thereof may be possible. Hereinafter are disclosed references, preparative examples of non-diffusible oxidants of this invention and comparative examples.

Reference-1

The following samples were prepared:

Sample A

Sample A was prepared by coating a photographic support with a gelatin aqueous solution so as to have 200 mg of the coated amount per 100 $cm^2$.

Sample B

In the above gelatin solution were added a 5% aqueous solution of 2,3,5-triphenyltetrazolium chloride (hereinafter, referred to as T-salt) and a 5% aqueous solution of DES by means of a double-jet method to obtain an ion pair of T-salt-DES. The ion pair solution was then coated on a polyethyleneterephthalate support in order that 200 mg of gelatin containing 30 mg calculated in terms of T-salt can be coated per 100 $cm^2$ of the support.

On the other hand, to a buffer solution having pH 10.0 (ionic strength: 0.1) consisting of potassium dihydrogen phosphate and sodium hydroxide was dissolved $1.0\times10^{-3}$ mol/l of the hydroquinone developing agents disclosed in Table 1 and this solution was added to the Samples A and B in an amount as small as possible. The higher mV of the surface oxidation-reduction potential of Sample B than that of Sample A was measured by using a platinum electrode and saturated calomel electrode as the comparative electrode. The results were listed in Table 1.

TABLE 1

| Difference between the oxidation and reduction potentials of Samples B and A (25° C.) | Developing agents | | |
|---|---|---|---|
| | Hydroquinone | Chlorohydroquinone | t-Butylhydroquinone |
| | 59 mV | 62 mV | 57 mV |

It is evident that from Table 1 that several hydroquinone developing agents were oxidized with the substantially non-diffusible oxidant.

Reference-2

The sample was prepared by coating an aqueous gelatin solution containing an ion pair consisting of T-salt and DES prepared according to preparative example-1 onto to a polyethylene terephthalate support so as to cover, and to provide 50 mg of gelatin/100 $cm^2$ and about 20 mg of the ion pair of T-salt and DES/100 $cm^2$ calculated in terms of T-salt and then drying.

Then, the diffusibility of this ion pair in a developer was examined by quantitatively measuring the remaining ion pair amount after the above sample was immersed into a developer having the following composition at 30° C. for 10 minutes:

| Developer composition | |
|---|---|
| Metol ® | 3.5 g |
| Anhydrous sodium sulfite | 60 g |
| Hydroquinone | 9.0 g |
| Sodium carbonate monohydrate | 54.0 g |
| Potassium bromide | 2.5 g |
| 5-Nitrobenzoimidazole | 0.5 g |
| 1-Phenyl-5-mercaptotetrazole | 10 mg |
| Water to make | 1000 ml |
| pH = 10.25 | |

The ion pair amount of T-salt and DES remaining in the sample was measured quantitatively as an amount of T-salt as follows:

The gelatin, 10 cm × 10 cm, in the sample was decomposed with a 0.1% pronase solution and sodium sulfide was added to this solution to reduce T-salt to formazan dye which was completely extracted with chloroform. The chloroform solution containing this formazan dye was measured spectrophotometrically using 480 nm wave length.

The results were listed in Table 2 for cmparison.

TABLE 2

| Sample | An amount of T-salt mg/100 cm$^2$ |
|---|---|
| The untreated sample | 2.03 |
| The sample immersed into the developer | 2.00 |

Then, the decreasing rate of T-salt in treated sample was calculated by the following equation:

$$\text{Decreasing rate} = \frac{[T\text{-salt amount in the untreated sample}] - [T\text{-salt amount in the treated sample}]}{[T\text{-salt amount in the untreated sample}]} \times 100$$

$$= \frac{2.03 - 2.00}{2.03} \times 100 = 1.48[\%]$$

This result showed clearly that the ion pair of T-salt and DES according to this invention was not dissolved out in the treatment liquid during development and was a substantially on-diffusible compound. The low diffusion rates of other non-diffusible compounds of this invention are able to be spectrally determined as described above.

Next, typical preparative examples of substantially non-diffusible compounds applicable preferably to this invention will be illustrated as follows.

Preparative Example-1

After 37 g of inactive gelatin was completely swelled in a cold water, 150 ml of 6.7% T-salt aqueous solution and 270 ml of 5% sodium diisopropylnaphthalenedisulfonate (hereinafter, referred to DIPN) aqueous solution were added to the above solution simultaneously within 5 minutes at 50° C. under vigorous stirring by means of a double-jet method and after further 30 minutes stirring, water was added to make 1 l.

Preparative Example-2

To 100 ml of a 10% gelatin solution at 40° C. were added 20 mg of a 5% hexaanmine cobalt (III) chloride solution and 60 ml of a 10% DES solution with vigorous stirring within two minutes by means of a double-jet method. After further 30 minutes stirring, water was added to make a total of 250 ml.

Preparative Example-3

This was prepared in the same way as in Preparative example-1 to obtain the desired ion pair except the DES was used instead of DIPN.

Preparative Example-4

This was prepared in the same way as in Preparative example-1 to obtain the desired ion pair except that 3-(p-hydroxyphenyl)-5-methyl-2-phenyl-2H-tetrazolium chloride instead of T-salt, and sodium p-dodecylbenzenesulfonate instead of DIPN were used.

Preparative Example-5

This was prepared in the same way as in Preparative example-1 to obtain the desired ion pair except that 1,1'-dimethyl-4,4'-bipyridium was used instead of T-salt.

Preparative Example-6

To 50 ml of water at 50° C. were added simultaneously 150 ml of a 6.7% T-salt solution and 270 ml of a 5% DIPN solution with vigorous stirring within 3 minutes to obtain a yellowish white precipitate, which was dried under reduced pressure.

Example-1

A fine silver chloro-bromo-iodide-gelatin emulsion containing 73.8 mole % silver chloride, 26 mole % of silver bromide and 0.2 mole % of silver iodide with an average grain size of 0.25 μm and with a surface (100) mainly and 85% of the whole grain number being 0.8 to 1.2 times said average grain size was chemically ripened with chloroauric acid and sodium thiosulfate. To 1 mole per silver halide of this emulsion were added a solution of 0.57 g of 4-hydroxy-6-methyl-1,3,3a,7-hetrazaindene and 1.7 g of an ion pair of T-salt DIPN as a non-diffusible oxidant obtained by Preparative example-6 in methanol and then, $1 \times 10^{-4}$ mole of bis-(methylenevinylsulfone) per 1 g of gelatin as a hardening agent. Saponin ® was then added thereto at an amount of 4% of the coating liquid and the liquid was coated on a polyethyleneterephthalate support. Further, on this silver halide emulsion layer was coated gelatin in an amount of 12 mg/100 cm$^2$ as a protective layer. The above light-sensitive silver halide photographic material was wedge-exposed through a contact screen (150 lines/inch) manufactured by Dainihon Screen Company with a pulsed xenon lump and treated by the following treatments.

| [Treatment processes] | |
|---|---|
| Development | 1 minute (30° C.) |
| Fixing | 1 minute |
| Water washing | 1 minute |
| Drying | 40 seconds (45° C.) |

The treating bath had the following composition.

| [Developer composition] | |
|---|---|
| Metol ® | 8.0 g |
| Anhydrous sodium sulfite | 60 g |
| Sodium carbonate monohydrate | 54 g |
| Potassium bromide | 2.5 g |
| 5-Nitroindazole | 60 mg |
| Water to make | 1 l |
| pH = 10.20 | |

| [Fixing solution composition] | |
|---|---|
| Ammonium thiosulfate | 150 g |
| Anhydrous sodium sulfite | 25 g |
| Ammonium acetate | 15 g |
| Acetic acid | 11 g |
| Aluminium sulfate | 20 g |
| Sulfuric acid | 10 g |
| Water to make | 1 l |

-continued

| | |
|---|---|
| pH = 5.30 | |

Example-2

This light-sensitive silver halide photographic material was prepared in the same way as in Example-1. $5\times10^{-5}$ mole of mucochloric acid and $5\times10^{-5}$ mole of 1,3,5-triacroyltriazine as a hardening agent were added per 1 g of gelatin. The same treating solutions as in Example-1 was used.

Example-3

This light-sensitive silver halide photograpic material was prepared in the same way as in Example-1. $10^{-4}$ mole of formalin was added as a hardening agent per 1 g of gelatin.

Example-4

The light-sensitive silver halide photographic material was prepared in the same way as in Example-1. The ion pair as a non-diffusible oxidant indicated in Preparative example-2 and $10^{-4}$ mole of glyoxal as a hardening agent were added thereto. A developer having the following composition was used.

| [Developer] | |
|---|---|
| Phenidone ® | 0.3 g |
| Metol ® | 6.0 g |
| Anhydrous sodium sulfite | 50 g |
| Potassium bromide | 2.5 g |
| Sodium carbonate | 30 g |
| 4-Hydroxy-6-methyl-1,3,3a,7-tetrazaindene | 0.1 g |
| 6-Nitroindazole | 50 mg |
| 5-Nitrobenztriazole | 70 mg |
| Water to make | 1 l |
| pH = 9.80 | |

Example-5

The light-sensitive silver halide photographic material was prepared in the same way as in Example-4. The ion pair as the non-diffusible oxidant indicated in Preparative example-5 was used and a developer having the following composition was used.

| [Developer] | |
|---|---|
| Phenidone ® | 0.3 g |
| Hydroquinone | 10 g |
| Sodium sulfite | 50 g |
| Sodium carbonate monohydrate | 30 g |
| Potassium bromide | 2.5 g |
| 5-Nitroindazole | 100 mg |
| Ethylenediamine tetraacetic acid disodium | 100 mg |
| Water to make | 1 l |
| pH = 10.20 | |

Comparative Example-1

The light-sensitive silver halide photographic material was prepared in the same way as in Example-1. But $10^{-5}$ mole of 1-hydroxymethyl-5,5-dimethylhydantoin as a hardening agent was added. The developer used in Example-4 was used.

Comparative Example-2

The light-sensitive silver halide photographic material was prepared in the same way as in Example-1, but 0.8 g of dibenzyl viologen as a non-diffusible oxidant was used instead of T-salt-DIPN.

Comparative Example-3

The light-sensitive silver halide photographic material was prepared in the same way as in Comparative example-2. But none of non-diffusible oxidant and none of diffusible oxidant were added. As a developer, a lith type developer having the following composition was used.

| [Developer] | |
|---|---|
| Hydroquinone | 15 g |
| Sodium sulfite | 2.5 g |
| Formaldehyde sodium hydrogen sulfite | 60 g |
| Sodium carbonate monohydrate | 85 g |
| Polyethylene glycohol (average molecular weight 1,500) | 1 g |
| Water to make | 1 l |
| pH = 9.80 | |

These results were shown in Table 3.

TABLE 3

| | Swelling rate of the hydrophilic colloidal layer (gelatin layer) (times) | γ | Dot* quality | Storability** of the developer |
|---|---|---|---|---|
| Example-1 | 1.5 | 18 | 5 | 6 weeks |
| Example-2 | 3.2 | 20 | 5 | 6 weeks |
| Example-3 | 2.8 | 18 | 4 | 8 weeks |
| Example-4 | 2.9 | 20 | 5 | over 10 weeks |
| Example-5 | 2.8 | 18 | 4 | over 10 weeks |
| Comparative example-1 | 1.1 | 4.5 | 1 | 6 weeks |
| Comparative example-2 | 4.7 | 12 | 2 | over 10 weeks |
| Comparative example-3 | 1.6 | 16 | 4 | 4 weeks |

*"Dot quality" here means usually estimated value of images obtained through a contact screen. The dot image is composed of the generally "shadow dot" and the part known as "highlight part". In the intermediate part of these parts are arranged uniformly dots having several kinds of size. "Dot quality" in Table 3 means a estimated value of the dot in the part having 50% dot in which a half of a definite area is clear and the rest of it is a developed image and the dot quality is expressed in progressive scale. That is, "5" means extreme excellence and "4" means excellent and "1" extreme badness. Dot quality below 3 can not be generally permitted.

**"Storability of developer" means the time that is necessary for the sensitivity to decrease until ½ when the finished developer was allowed to stand in a developing tray.

When it is over 6 weeks, there is no problem in practice. As is clear from Table 3, γ is low in Comparative example-1 because a non-diffusible oxidant of this invention was not used. As in Example-5, the sample having an ion pair obtained by reacting a diffusible oxidant with a sulfonic acid salt having a large volume to make a non-diffusible oxidant had an excellent dot quality with high-contrast.

In all the examples indicated in Table 3 there was carried out the regulation (control) of this invention for swelling of the hydrophilic colloidal layer (e.g. a gelatin layer). On the other hand, as in Comparative example-2, the dot quality in which the swelling regulation was not carried out is broad in fringe width and of low quality and the producibility of small points below 10% dot deteriorates extremely and the γ value is insufficient. It is clear from this that the swelling regulation of the hydrophilic colloidal layer (e.g. a gelatin layer) according to this invention is very important.

Examples in Table 3 are exemplified examples of forming dots in the light-sensitive silver halide photographic material of this invention and indicate that conventional lith type developer is not necessary. The lith type developer can make dots with better quality combination with a lith type silver halide emulsion, which fact is shown in Comparative example-3. But decrease in activity of the developer due to air oxidation is remarkable and a clear difference between it and the light-sensitive silver halide photographic material of this invention is recognized.

Example-6

A silver iodobromide gelatin emulsion containing 98.5 mole % of silver bromide and 1.5 mole % of silver iodide with an average grain size of 0.42 μm and over 75% of the whole grain number which is substantially optically sensitive being cubic was chemically ripened. 150 mg of 3,3-diethyl-9-ethyl-4,5,4',5'-dibenzothiacarbocyanine bromide per 1 mole of silver halide as a sensitizing dye, 2.5 g of Saponin ®, 2.4 g of the non-diffusible oxidant used in Preparative example-1 and $1\times10^{-4}$ mole of bis(methylenevinylsulfone) were further added thereto and the emulsion was coated on a polyethyleneterephthalate support. On this silver halide emulsion layer was coated gelatin in an amount of 14 mg/100 $cm^2$ as a protective layer. This light-sensitive silver halide photographic material was exposed through a step wedge or a step wedge and contact screen with a laser-light using helium-neon laser emitter (manufactured by Nihon Electric Company, Ltd., Gas-laser GLG2004). The exposure time was $10^{-4}$ second. The exposed photographic material was treated by the following treatment processes.

| [Treatment processes] | |
|---|---|
| Development | 45 seconds (35° C.) |
| Fixing | 45 seconds |
| Water washing | 40 seconds |
| Drying | 32 seconds (50° C.) |

Among the treating solutions, the same fixing solution as used in Example-1 was used and a developer having the following solution was used.

| [Developer composition] | |
|---|---|
| Phenidone ® | 0.8 g |
| Hydroquinone | 25 g |
| Potassium carbonate | 15 g |
| Potassium hydroxide | 16 g |
| Sodium sulfite | 50 g |
| 5-Nitrobenztriazole | 70 mg |
| 1-Phenyl-5-mercaptotetrazole | 10 mg |
| 5-Nitrobenzimidazole | 100 mg |
| Water to make | 1 l |
| pH = 10.20 | |

Example-7

The light-sensitive silver halide photographic material was prepared in the same way as in Example-6. The ion pair used in Preparative example-5 as a non-diffusible oxidant, $2\times10^{-5}$ mole of mucochloric acid and $5\times10^{-5}$ mole of glyoxal as a hardening agent were used. The treatments were carried out in the same way as in Example-6.

Example-8

The light-sensitive silver halide photographic material was prepared in the same way as in Example-7. The ion pair used in Preparative example-2 was used as a non-diffusible oxidant. The treatments were carried out in the same way as in Example-6.

Example-9

The light-sensitive silver halide photographic material was prepared in the same way as in Example-7. $10^{-4}$ mole of bis(trimethyleneiminocarbonylethyleneimine) was used as a hardening agent. The treatments were carried out in the same way as in Example-6.

Comparative Example-4

The light-sensitive silver halide photographic material was prepared in the same way as in Example-6. None of non-diffusible oxidant was added. $5\times10^{-6}$ mole of formalin was added as a hardening agent. Two treatments were the same as in Example-6.

The swelling rate, γ and dot quality of the hydrophilic colloidal layer (the gelatin layer) of Examples 6–8 and Comparative example-4 were measured. The results were shown in Table 4.

TABLE 4

| | Swelling rate of the hydrophilic colloidal layer (gelatin layer) (times) | γ | Fog | Dot quality |
|---|---|---|---|---|
| Example-6 | 2.2 | 6.5 | 0.04 | 3.5 |
| Example-7 | 3.2 | 4.0 | 0.05 | 3.0 |
| Example-8 | 3.2 | 5.5 | 0.05 | 3.5 |
| Example-9 | 1.3 | 4.1 | 0.06 | 3.0 |
| Comparative example-4 | 4.8 | 3.5 | 0.20 | 1.0 |

As is clear from Table 4, in the light-sensitive silver halide photographic material according to this invention, γ value is high and fog is low. So, this photographic material meets the object of such printing sensitive materials as facsimile or typesetting use and has excellent high quality. It is evident that dot images applicable in practical use can be obtained by the light-sensitive silver halide photographic material disclosed in the above Examples. It is also found that stable dot images can be obtained by using silver iodobromide which was not expected to form dots in conventional techniques. More concretely the light-sensitive silver halide photographic material according to this invention has advantages in that it has high stability on storage and preparation.

What is claimed is:

1. A high-contrast light-sensitive silver halide photographic material which comprises a support, a (i) silver halide emulsion containing silver halide grains, said silver halide grains in said silver halide emulsion having an average grain size between 0.25 and 0.5 μm and, at least 80% of said silver halide grains are of a grain size which falls within the range of from 0.6 times said average grain size to 1.4 times said average grain size, and (ii) another hydrophilic colloidal layer coated on the support, at least one layer selected from the group consisting of said silver halide emulsion layer and said another hydrophilic colloidal layer containing at least one substantially non-diffusible compound having oxidizing power on a hydroquinone developing agent and selected from the group consisting of (a) a tetrazolium compound having the following formula:

I

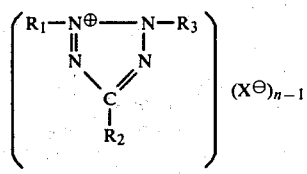

II

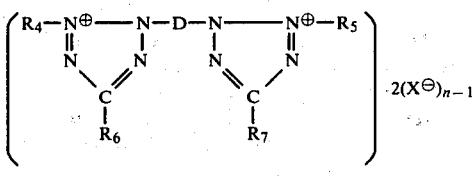

III

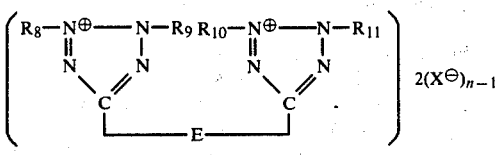

wherein $R_1$, $R_3$, $R_4$, $R_5$, $R_8$, $R_9$, $R_{10}$ and $R_{11}$ individually represent an alkyl group including alkyl and substituted alkyl, an allyl group including allyl and substituted allyl, a phenyl group including phenyl and substituted phenyl, a naphthyl group including naphthyl and substituted naphthyl, a heterocyclic group including heterocyclic and substituted heterocyclic or may be a group forming a metal chelate or complex; $R_2$, $R_6$ and $R_7$ individually represent an allyl group including allyl and substituted allyl, a phenyl group including phenyl and substituted phenyl, a heterocyclic group including heterocyclic and substituted heterocyclic, an alkyl group including alkyl and substituted alkyl, an amino group including amino and substituted amino, hydroxyl, carboxyl or salt thereof, mercapto, nitro or hydrogen; D represents an arylene group; E represents an alkylene group including alkylene and substituted alkylene, an allylene group including allylene or substituted allylene or an aralkylene group including aralkylene and substituted aralkylene; $X^{\ominus}$ represents an anionic surface active moiety having at least 9 carbon atoms; n represents an integer 1 or 2 providing that when the compound forms a molecular inner salt, n is 1, (b) a triazolium compound having the formula; $[T]^{\oplus}(X^-)_n$ wherein $[T]^{\oplus}$ represents triazolium cation selected from 1-Methyl-2-phenyl-2H-1,2,3-triazolium, 1-n-propyl-2-phenyl-2H-1,2,3-triazolium, 2-(4-Methoxyphenyl)-3-phenyl-2H-naphtho[1,2-d]-1,2,3-triazolium, 1,5-(9,10-anthraquinolyl)-bis-{2-[3-phenyl]-2H-naphtho-[1,2-d]-1,2,3-triazolium} and 2,3-di(4-Methoxyphenyl)-5-nitro-2H-naphtho-[1,2-d]-1,2,3-triazolium, n is 1, and $X^-$ represents an anionic surface active moiety having at least 9 carbon atoms, (c) a bipyridinium compound having the formula; $[B]^{2+}(X^-)_2$ wherein $[B]^{2+}$ represents a bipyridinium cation selected from 1,1'-Dimethyl-4,4'-bipyridinium, 1,1'-Diethyl-4,4'-bipyridinium and 1,1'-Dibenzyl-4,4'-bipyridinium, and $X^-$ represents an anionic surface active moiety having at least 9 carbon atoms, (d) a metal complex compound represented by the general formula; $[M'\text{-}Z]^{n'\oplus}(X^{\ominus})_{n'}$ wherein M' represents a metal, n' is an integer of 2 to 4, Z represents ligands which form metal complex compound, $[M'\text{-}Z]^{\oplus}$ being selected from hexaammine cobalt (III), triethylenediamine cobalt (III), bis(diethanolamine) cobalt (III), hexaammine chromium (III), bis(dipropanolamine) chromium (III), bis(ethylenediamine) trimethylenediamine cobalt (III) and ethylenediamine tetraacetic acid iron (III), and $X^{\ominus}$ represents an anionic surface active moiety having at least 9 carbon atoms, (e) a non-diffusible inorganic oxidant selected from tetraphenylphosphonium bichromate, tetraphenylphosphonium permanganate and tetraphenylarsonium perchromate and (f) an N-chloroarylsulfonamide compound represented by the general formula;

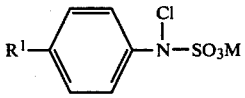

wherein $R^1$ represents an alkyl group including alkyl and substituted alkyl having 6 to 12 carbon atoms, M represents an alkali metal atom, said substantially non-diffusible compound being a compound which when said photographic material is inserted into an aqueous developing solution will not diffuse from said photographic material in an amount greater than 2%, said at least one layer containing said substantially non-diffusible compound having the following swelling characteristics:

when said at least one layer is dried at 23° C. in an atmosphere having a relative humidity of 55% and is then immersed in an aqueous solution having a temperature of 23° C. and the following composition

| | |
|---|---|
| ethylenediaminetetraacetic acid disodium | 0.1 g |
| sodium sulfite | 30 g |
| potassium bromide | 2.5 g |
| sodium carbonate monohydrate | 30 g |
| sodium hydroxide | 1 g |
| water to make a total of | 1 l |
| pH | 10.25 |

it will swell to a thickness which is from 1.2 to 4.5 times the thickness of said at least one layer when dried.

2. A high-contrast light-sensitive silver halide photographic material as claimed in claim 1 in which an oxidation reduction potential of said substantially non-diffusible compound is more 80 mV positive than that of hydroquinone at a pH of 10.0 and said silver halide is silver chloroiodo-bromide or silver chlorobromide.

3. A high-contrast light-sensitive silver halide photographic material as claimed in claim 1 in which said substantially non-diffusible compound is 2,3,5-triphenyl-2H-tetrazolium and diisopropylnaphthalenesulfonic acid or diethylhexylsuccinatesulfonic acid.

4. A high-contrast light-sensitive silver halide photographic material as claimed in claim 1 in which said non-diffusible compound is selected from the group consisting of N-chloro-p-dodecylbenzenensulfonamide sodium and N-chloro-p-nonylbenzenesulfonamide sodium.

5. A high-contrast light-sensitive silver halide photographic material as claimed in claim 1 in which said support is composed of polyethyleneterephthalate.

6. A high-contrast light-sensitive silver halide photographic material as claimed in claim 1 wherein said substantially non-diffusible compound is one of said tetrazolium compounds and $R_1$, $R_2$ and $R_3$ each represent a phenyl group.

7. A high-contrast light-sensitive silver halide photographic material as claimed in claim 6 wherein the anionic surface active moiety is represented by the general formulae[IV], [V], [VI], [VII] and [VIII], Formula [IV]

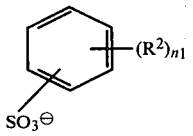

wherein $R^2$ represents an alkyl group, $n_1$ is an integer of 1 to 3,

Formula [V]

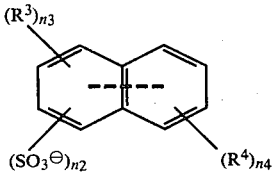

wherein $R^3$ and $R^4$ individually represent hydrogen, an alkyl group; $n_2$, $n_3$ and $n_4$ are an integer of 1 to 3, Formula [VI]

$$R^5-\underset{\underset{R^6}{|}}{CH}\leftarrow R^7-O\rightarrow_{n_5}-A$$

wherein $R^5$ and $R^6$ individually represent hydrogen, an alkyl group, $R^7$ represents ethylene group and propylene group, $n_5$ is an integer, A represents $-SO_3^{\ominus}$ and $-COO^{\ominus}$, Formula [VII]

$$R^8-\underset{\underset{R^9-CH_2}{|}}{CH}-SO_3^{\ominus}$$

wherein $R^8$ represents hydrogen, an alkyl group and an alkoxycarbonyl group; $R^9$ represents an alkyl group and an alkyloxycarbonyl group, Formula [VIII]

$$R^{10}-COO^{\ominus}$$

wherein $R^{10}$ represents saturated or an unsaturated alkyl group.

8. A high-contrast light-sensitive silver halide photographic material as claimed in claim 7 wherein the anionic surface active moiety is selected from the group consisting of:

a p-dodecylbenzenesulfonic acid anion,
a laurylsulfate anion,
a di-2-ethyl-hexylsulfosuccinate anion,
a cetyl polyethenoxysulfate anion,
stearic acid anion and a polyacrylic acid anion.

9. A high-contrast light-sensitive silver halide photographic material as claimed in claim 1, wherein the anionic surface active moiety is selected from the group consisting of an higher alkylbenzenesulfonic acid anion,
a dialkylsulfosuccinate anion,
a polyetheralcoholsulfuric acid ester anion,
a higher aliphatic acid anion or
a polymer having an acid radical.

10. A high-contrast light-sensitive silver halide photographic material as claimed in claim 1 in which said substantially non-diffusible compound is selected from those compounds specified in subparagraphs a, b, c, e and f of said claim 23.

* * * * *